United States Patent [19]

Mitsuya et al.

[11] Patent Number: 4,644,980

[45] Date of Patent: Feb. 24, 1987

[54] DEVICE FOR INSERTING WEFT YARN IN A FLUID JET LOOM

[75] Inventors: Kinpei Mitsuya; Mitsuhiro Iwasaki, both of Kariya, Japan

[73] Assignee: Kabushiki Kaisha Toyoda Jidoshokki Seisakusho, Kariya, Japan

[21] Appl. No.: 806,778

[22] Filed: Dec. 9, 1985

[30] Foreign Application Priority Data

| | | | |
|---|---|---|---|
| Dec. 28, 1984 | [JP] | Japan | 59-275215 |
| Feb. 9, 1985 | [JP] | Japan | 60-24123 |
| Feb. 22, 1985 | [JP] | Japan | 60-34977 |

[51] Int. Cl.[4] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,685,553 | 8/1972 | Sakamoto | 139/435 |
| 4,326,565 | 4/1982 | Mullekom | 139/435 |
| 4,328,842 | 5/1982 | Scheffel | 139/435 |
| 4,565,226 | 1/1986 | Tsuji | 139/435 |

FOREIGN PATENT DOCUMENTS

| | | | |
|---|---|---|---|
| 1449084 | 7/1966 | France | 139/435 |

*Primary Examiner*—Henry S. Jaudon

*Attorney, Agent, or Firm*—Brooks Haidt Haffner & Delahunty

[57] ABSTRACT

A device for weft insertion has a weft guide channel defined by a number of reed teeth or weft yarn guide members arranged in juxtaposition to the reed, and at least two main nozzles that are used selectively for weft insertion. At least one weft-inserting main nozzle adapted to project the weft yarn towards the weft yarn guide channel has its fluid jet opening directed parallel to the longitudinal axis of the weft guide channel, the other weft-inserting main nozzles having their jet axes inclined with respect to the longitudinal axis of the weft yarn guide channel and directed both downstream of the channel and towards the recessed wall surface opposite to the open side of the channel.

16 Claims, 23 Drawing Figures

DEVICE FOR INSERTING WEFT YARN IN A FLUID JET LOOM

BACKGROUND OF THE INVENTION

This invention relates to a fluid jet loom such as an air jet loom and more particularly to a device for inserting the weft yarns into the weft guide channel of the loom by the selective use of a plurality of weft-inserting main nozzles.

In actuating a plurality of main nozzles in accordance with a weft yarn selection program for selectively inserting plural weft yarns supplied from plural weft yarn supply sources into warp sheds, it is known to direct the axes of the jets from the several fixed weft-inserting main nozzles parallel to the weft yarn guide channel. In the case of what is called the modified reed, in which recessed guide apertures are formed on the front sides of the reed teeth for forming a weft yarn guide channel in the reed itself, the forward end of the weft yarn, as it is projected from the main nozzle along the jet axis of the main nozzle in the vicinity of these yarn exit apertures of the reed teeth, is apt to escape through the open side of the reed at the outset of weft insertion.

The Japanese Laid-open Utility Model Publication No. 19075/1978 shows an example of a weft-inserting device designed to eliminate the above described drawback caused by forming the weft guide channel with a larger opening area in the modified reed. The prior-art device makes use of a pair of weft-inserting main nozzles. One of these main nozzles has its jet axis directed towards the recessed wall surface opposite to the opening side of the channel whereas the other main nozzle has its jet axis directing to the opening side of the channel. A set of auxiliary nozzles are provided on the opening side, facing and in the direction of the jet axis of the other main nozzle.

With the above described prior-art device, it is necessary to provide these auxiliary nozzles in order to prevent the forward ends of the weft yarns, as they are projected along the jet axis towards the opening side of the weft yarn guide channel, from exiting through the opening side of the channel. Thus, these auxiliary nozzles have a function which is different from that of conventional auxiliary nozzles, which is to assist in the forward travel of the weft yarns. This results in an increased number of component parts with increased costs and a complicated design.

In a jet loom adapted to project the weft yarns from the weft yarn main nozzle into the warp shed, there is also known a weft-inserting system wherein a large number of weft yarn guide members are juxtaposed in the weft-inserting direction for defining the yarn guide channel and wherein a set of auxiliary nozzles is arranged between the reed and the weft yarn guide members to assist in the forward travel of the yarn projected and inserted in the guide channel. This system makes it possible to reduce the jet pressure, while also preventing the risk of yarn breakage and reducing the consumption of the jet fluid. The effect may be further improved by having a smaller cross-sectional area of the weft yarn guide channel.

However, in the weft-inserting system shown in the Japanese Publication No. 19075/1978, since the weft yarn guide channel is naturally provided with an opening to permit the weft yarn to escape therethrough prior to beating the yarn to the previously inserted yarn, the forward end of the weft yarn projected from the main nozzle whose jet axis is directed, towards the opening side is apt to exit therethrough, thus causing a failure in weft insertion and thereby affecting operating efficiency.

Thus, the main nozzle disposition shown in the Japanese Publication No. 19075/1978 can be used only with a sacrifice in the operating efficiency of the loom.

On the other hand, when the plural weft-inserting main nozzles are not fixed, it is necessary to provide means whereby the respective weft-inserting main nozzles may be selectively positionally switched to the weft-inserting position aligned with the weft yarn guide channel. As an example of such switching means, the Japanese Laid-open Patent Publication No. 133248/1982 shows a cam mechanism driven in time with the rotation of the loom to cause rocking of an associated shaft in such a manner that a pair of weft-inserting main nozzles on a bracket secured to the shaft may be positionally switched to the weft-inserting position.

However, in the cam-actuated weft-inserting system, each weft insertion pattern is associated with a specified cam profile so that cam replacement is necessary whenever a new weft insertion pattern is selected. In addition, the cam profile is necessarily complicated even when the pattern is complicated only slightly. This means that the weft insertion pattern is rather simple, despite the fact that the troublesome operation of replacing the cam needs to be performed when changing the weft insertion pattern. Also, problems are sometimes presented in that the positional switching of the main nozzles is unable to keep up with the operation of the high speed loom.

The Japanese Laid-open Patent Publication No. 43148/1984 shows an example of the weft-inserting device wherein the weft insertion pattern can be changed freely without changing the cams. Thus, a pair of magnetic solenoids may be energized or deenergized for driving two pins to thereby switch the pair of main nozzles supported by a lever to permit the desired setting of the weft yarn selection program or the weft insertion pattern. However, in the prior-art device, a large number of rotary levers are required for converting the rotary movement of the cam into the main nozzle switching operation. Moreover, the main nozzle is difficult to affix to the sley so that the lever supporting the pair of main nozzles needs to be swung in time with the sley, resulting in a complicated device. The driving pins and the lever need to be engaged with high accuracy, but such is possible only with considerable difficulties. Problems are also presented in regarding compatibility of the arrangement with the operation of a high speed loom such as a jet loom. In addition, with an increase in the number of the main nozzles, the structure and cam profile also become increasingly complicated so that it becomes extremely difficult to selectively introduce three or more weft yarns.

The Japanese Laid-Open Patent Publication No. 142747/1980 shows an example of the device for selective insertion of four weft yarns with the use of four main nozzles. In the prior-art device, two main nozzles are placed on top of two horizontally arranged main nozzles, these nozzles being vertically and transversely movable for selectively placing one of these nozzles in the weft-inserting position. However, in the device of the Japanese Publication No. 142747/1980, two driving units are required for shifting the main nozzle vertically and transversely thus resulting in increased complicity in the structure and driving control, and difficulty in achieving fast response for cooperation with the high speed loom.

SUMMARY OF THE INVENTION

It is therefore a principal object of the present invention to provide a weft inserting device for a jet loom whereby optimum weft yarn selection and insertion can be achieved without separately providing auxiliary nozzles ahead of the weft-inserting main nozzles for the purpose of preventing the forward end of the weft yarn from escaping out of the weft yarn guide channel.

It is another object of the present invention to provide a weft inserting device for a fluid jet loom whereby free selection of the weft inserting pattern and optimum weft insertion compatible with the weaving operation of the high speed loom can be achieved without the necessity of positionally switching between plural weft-inserting main nozzles.

It is a further object of the present invention to provide a weft-inserting device in a fluid jet loom wherein a set of main nozzles, consisting of at least three weft-inserting main nozzles, are superimposed one upon the other, and wherein the set of these nozzles can be positionally switched to and from the weft-inserting position to follow the weaving operation of the high speed loom solely by the vertical movement of the group of main nozzles.

The present invention resides in a weft-inserting device for a fluid jet loom wherein a plurality of auxiliary nozzles adapted for assisting in the forward travel of the weft yarn are arranged along a weft guide channel defined by a row of weft guides and opening towards the auxiliary nozzles, and wherein a plurality of weft-inserting main nozzles are selectively used for inserting the weft yarn into said guide channel, characterized in that the jet axis of at least one of the main nozzles adapted for projecting the weft yarn towards and into said guide channel is directed parallel to the direction of the guide channel, and that the jet axis or axes of the other main nozzle or nozzles are inclined with respect to the direction of the guide channel so as to be directed through said guide channel and towards the recessed inner wall surface of the channel which is opposite to the side of the channel opening towards the auxiliary nozzles. The yarn guides defining the weft guide channel may be a number of juxtaposed yarn guide members parallel to the reed.

Since the jet axes of the plural weft-inserting main nozzles other than those directed parallel to the direction of the weft guide channel are directed towards the recessed inner wall surface of the guide channel opposite to the opening side of the channel, it is possible to prevent the situation in which the area of diffusion of the jet is widened outward from the opening side of the guide channel. The result is that, even when the forward end of the weft yarn projected from the main nozzle is travelling in the vicinity of the cone of diffusion of the jet fluid at the opening side of the guide channel, there is no risk that the forward end of the weft yarn projected from the main nozzle exist through the open side of the channel at the outset of weft insertion. The auxiliary nozzle designed to prevent the escape of the forward end of the weft yarn may also be dispensed with.

According to one aspect of the present invention, there is provided a weft insertion device for a jet loom wherein a plurality of weft-inserting main nozzles are selectively used for inserting the weft yarn into a weft guide channel defined by a row of weft guide members in opposition to the reed, for assisting the forward travel of the projected yarn in the weft guide inserting direction, and wherein auxiliary nozzles are provided between the reed and the yarn guide members for assisting the forward travel of the weft yarn, characterized in that at least one weft-inserting main nozzle adapted to project the weft yarn into said guide channel has its jet axis extending parallel to said channel, the remaining weft-inserting main nozzle or nozzles are juxtaposed adjacent to said at least one main nozzle but disposed towards said auxiliary nozzles, and that the jet axis or axes of the weft-inserting main nozzle or nozzles disposed towards the auxiliary nozzles are inclined through the guide channel with respect to the direction of the guide channel so as to be directed opposite to the escape aperture out of the guide channel.

In the above described weft-inserting device, the weft yarn projected from the weft-inserting main nozzle arranged towards the reed and having its jet axis directed opposite to the weft exit opening is introduced into the guide channel without the forward end of the yarn colliding against the weft yarn guide members. Since the forward end of the yarn travels away from the yarn exit aperture at the outset of the weft insertion, there is no risk of the forward end of the yarn escaping from the aperture. On the other hand, the forward end of the weft yarn projected from the main nozzle having its jet axis extending parallel to the direction of the weft guide passage is caused to travel along the recessed inner wall surface of the channel at the outset of weft insertion and inhibited from exiting through the aperture opposite to and spaced from the recessed inner wall surface. In this manner, the weft yarn introduced into the weft yarn guide passage is assisted in the forward travel thereof by the fluid projected from the auxiliary nozzles.

The weft yarn projection from the plural weft-inserting main nozzles may be effected solely by control of the fluid projection and without positional switching of the main nozzles to follow up with the weaving operation of the high speed loom.

According to another aspect of the present invention, there is provided a weft insertion device for a jet loom wherein a plurality of auxiliary nozzles for assisting in the forward travel of the weft yarn are arranged along the weft guide channel defined by a row of weft guides and opened towards the auxiliary nozzles, and wherein at least three weft-inserting main nozzles are selectively used for inserting the weft yarn into said guide channel, characterized in that the jet axes of at least two of the main nozzles are directed parallel to the weft yarn guide channel and vertically aligned with one another. The jet axes of the remaining main nozzles that are arranged in the vicinity of said at least two main nozzles are inclined with respect to the weft guide channel so as to be directed to the recessed inner wall surface of the weft guide channel, these weft-inserting nozzles being vertically reciprocated as one unit.

The set of juxtaposed auxiliary nozzles are vertically switched to and from the weft-inserting position by the operation of the reciprocating driving unit such that preset ones of the main nozzles of the set are actuated for projecting the weft yarns into the warp shed. The weft yarn projected from the weft-inserting main nozzle with the jet axis inclined with respect to the direction of the guide channel is introduced into the channel without the forward end thereof colliding against the weft guides. Since the forward end of the weft yarn is caused to travel at the outset in a direction away from the exit aperture, there is no risk of the end of the yarn exiting through the aperture. On the other hand, the forward end of the yarn projected from the weft-inserting main nozzle having the jet axis extending parallel to the direction of the weft guide channel is caused to fly along the recessed inner wall surface of the channel opposite to and spaced from the yarn exit aperture at the outset of weft insertion to prevent the situation in which weft yarn may exit through the aperture. This is done in such a manner that the weft yarn inserted into the weft yarn guide channel is assisted in the forward travel thereof by the fluid projection from the auxiliary nozzles.

Therefore, for shifting preset ones of the plural weft-inserting main nozzles to the weft-inserting position for projecting the yarn, it is only necessary to vertically shift the plural juxtaposed weft-inserting main nozzles for bringing desired ones of the main nozzles to the weft-inserting position thus assuring free weft-inserting pattern selection and optimum weft-inserting operation in order to follow up with the weaving operation of the high speed loom.

These and other advantages and attainments of the present invention will become apparent to those skilled in the art upon a reading of the following detailed description when taken in conjunction with the drawings wherein there are shown and described illustrative embodiments of the present invention.

BRIEF DESCRIPTION OF THE DRAWINGS

In the course of the following detailed description, reference will be made to the attached drawings in which.

DESCRIPTION OF THE PREFERRED EMBODIMENTS

Figure 1:
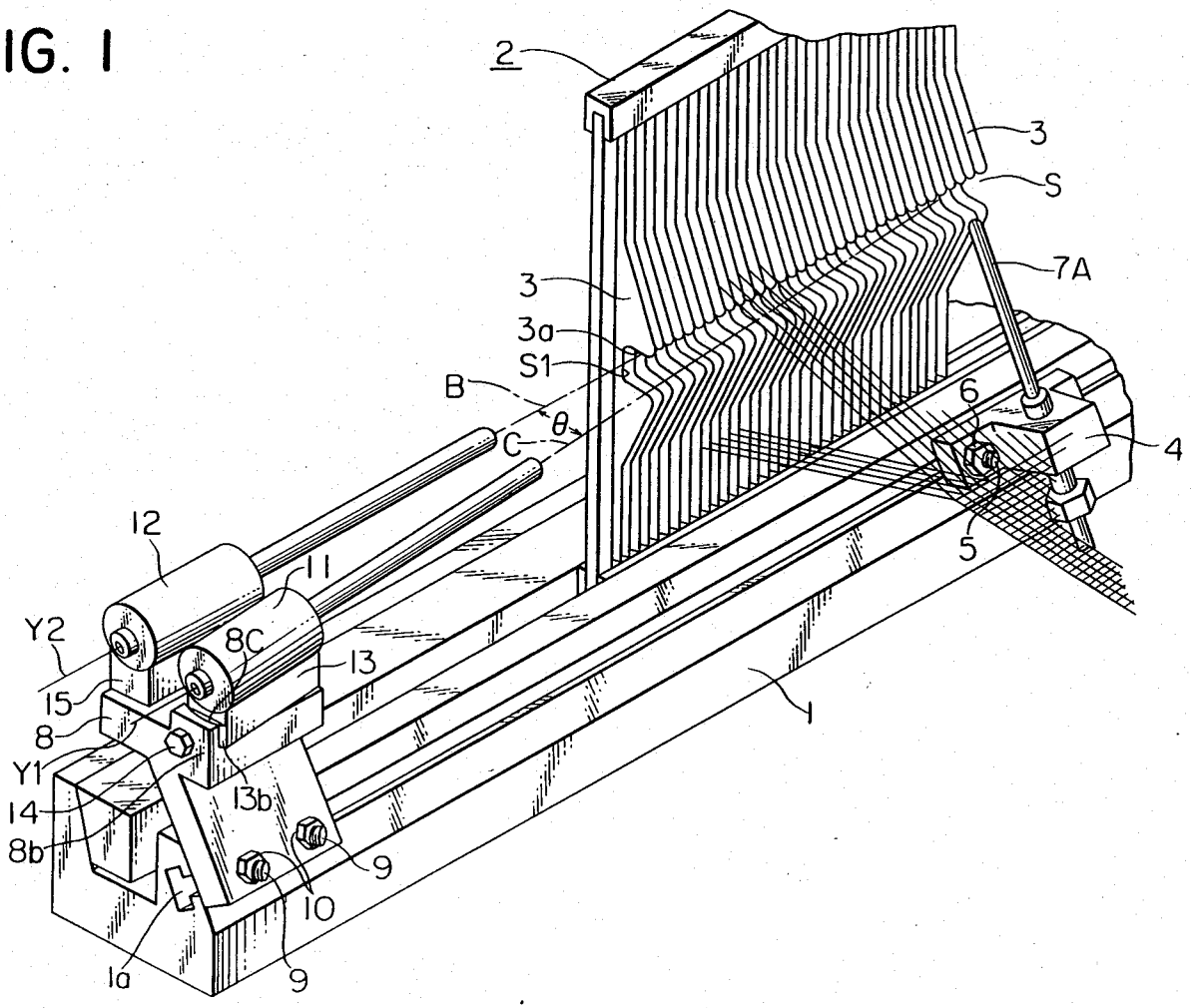
FIG. 1 is a perspective view showing a first embodiment of the weft-inserting device of the fluid jet loom of the present invention.
Figure 2:
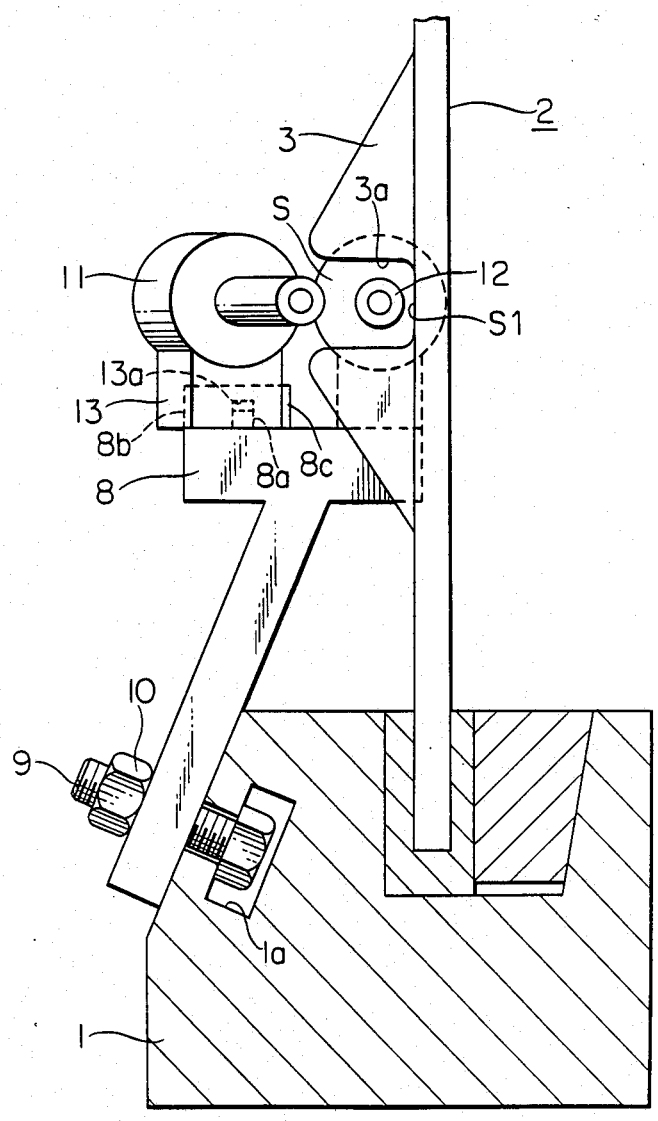
FIG. 2 is a side longitudinal section of the device of FIG. 1 when seen from the side opposite to the main nozzles.
Figure 3:
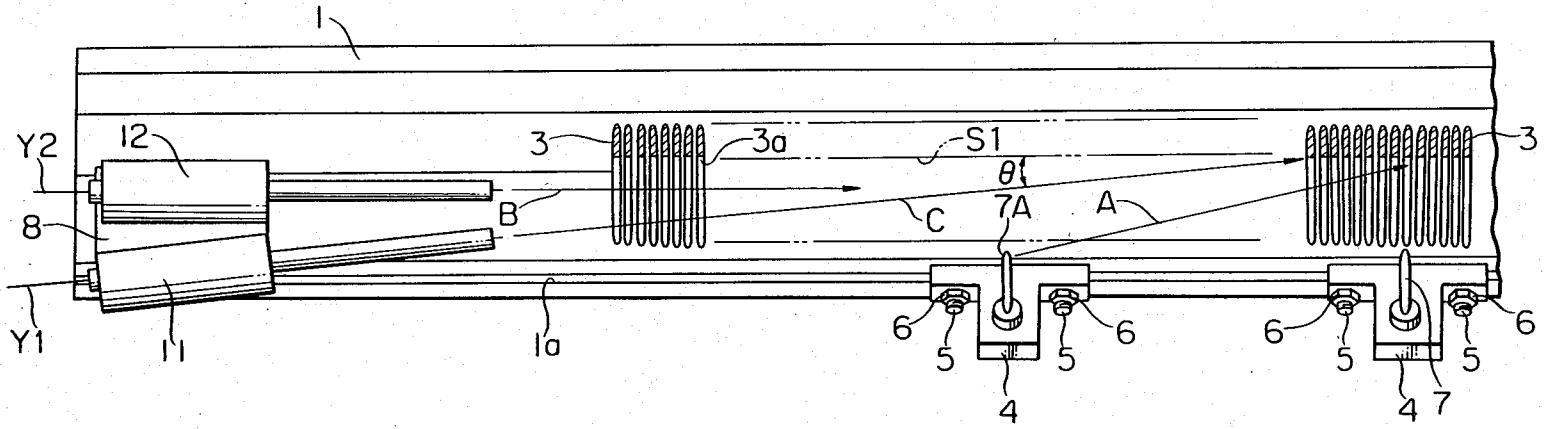
FIG. 3 is a plan view of the device of FIG. 1.

Referring to the accompanying drawings, wherein the same numerals are used to depict the same or equivalent parts, certain preferred embodiments of the present invention will be explained in detail. Referring first to FIGS. 1 to 3, the weft-inserting device according to a first embodiment of the present invention will be explained.

At the front side of the sley 1 is attached a reed 2 for guiding the forward travel of the filling weft yarn. On the front sides of a number of teeth 3 of the reed is formed a row of guide grooves 3*a* defining a weft guide channel S. On the front side of the sley 1 is formed a longitudinal guide groove 1*a*. A plurality of supporting blocks 4 are slidably mounted in positions corresponding to the reed 2 of the sley 1 by bolts 5 and nuts 6 in the groove 1*a* for positional adjustment along the guide groove 1*a*. In each supporting block 4, auxiliary nozzles 7, 7A are vertically passed and secured. These nozzles are placed so that jet ports, not shown, at the foremost parts of these nozzles 7, 7A are placed in the vicinity of the guide channel S such that the auxiliary jet fluid from the jet ports assists in the forward travel of the weft yarn introduced into the weft guide channel S. The jet axis of the fluid from the nozzles 7, 7A is directed as shown in the arrow mark A in FIG. 3 to intersect the recessed wall S1 of the guide channel S.

On the front or weft-inserting side of the sley 1, there is slidably mounted a carrier 8 by bolts 9 and nuts 10 along the guide groove 1*a* similarly to the supporting blocks 4. On the upper surface of one side (corresponding to the right side in FIG. 1) of the carrier 8 is formed a columnar engaging boss 8*a* (FIG. 2). On the opposite side of the carrier 8 is similarly provided an engaging piece 8*b*, the inner side of which is formed with a recessed arcuate surface 8*c* centered about the engaging boss 8*a*.

On one nozzle 11 of a pair of weft-inserting main nozzles 11, 12 mounted on the carrier 8 is secured a supporting base 13 having a columnar engaging recess 13*a* in which may be engaged the boss 8*a*. On the rear side of the supporting base 13 is formed a protuberant arcuate surface 13*b* mating with the arcuate surface 8*c*. With the boss 8*a* and the recess 13*a* mating with each other and with the arcuate surfaces 8*c*, 13*b* mating with each other, the supporting base 13 is clamped and secured to the support 8 by a screw 14 introduced from the rear end face of the piece 8*b* for attaching the main nozzle 11 on the support 8. In this manner, the weft-inserting main nozzle 11 can be turned in a controlled manner about the boss 8*a* on the support 8 as center.

The second weft-inserting main nozzle 12 is secured on the support 8 through the medium of a supporting base 15 at the rear side of the nozzle 11 or at the side of the reed 2, with the jet axis thereof directed as shown by the arrow mark B in FIG. 3 and parallel to the direction of the weft yarn guide channel S.

In the present embodiment, the main nozzle 11 is adjustably mounted to the support 8 in such a manner that the jet axes of the fluid from the nozzles 11, 12 direct to a point closer to the nozzles 11, 12 than the point of intersection with the recessed inner wall side S1 of the weft guide channel S of the jet axis A of the auxiliary nozzle 7A associated with the main nozzle 11. The angle at which the axis C is tilted with respect to the longitudinal axis of the weft guide channel S is indicated by an angle $\theta$ between the axis C and the wall surface S1 (FIGS. 1 and 3).

The main nozzles 11, 12 designed in this manner are actuated in accordance with the weft yarn selection program for projecting the weft yarns Y1 and Y2. The forward end of the yarn Y1 from the main nozzle 11 is projected mainly along the axis C to travel forward in the direction of the wall surface S1 of the guide channel S. The forward end of the yarn Y1 travelling in this manner is naturally displaced away from the opening side of the guide channel S so that there is no risk that the yarn exits out of the guide channel S. Although the fluid projected from the main nozzle 11 is naturally diffused, the fluid thus diffused is reflected by the wall surface S1 in the direction of the weft yarn guide channel so that the forward end of the yarn Y1 directed towards the wall surface S1 is caused by the reflected fluid to fly in the inserting direction without impinging on the wall surface S1 and may be shifted in this manner away from the wall surface S1. The forward end of the yarn Y1 thus shifted away from the wall surface S1 is again propelled towards the surface S1 and away from the opening side of the guide channel S by the operation of the auxiliary fluid projected from the nozzle 7A in the direction of the arrow mark A. In this manner, the forward end of the yarn Y1 discharged from the main nozzle 11 is prevented from moving away from the guide channel at the outset of weft insertion, and may be urged further under the assistance of the auxiliary nozzle 7A.

When the operation is switched from the main nozzle 11 to the main nozzle 12 in accordance with the weft yarn selection program, the weft yarn Y2 is projected from the main nozzle 12 so as to be inserted as conventionally into the weft guide channel S to be urged to travel further under the assistance of the auxiliary nozzles 7, 7A.

In this manner, the one main nozzle 12 has its jet axis B extending parallel to the direction of the guide channel S while the main nozzle 11 is mounted at an angle with respect to the direction of the weft yarn guide channel S so that the jet axis C of the nozzle 11 directs towards the recessed wall surface S1. The forward ends of the yarns Y1, Y2 projected from the main nozzles 11, 12 are prevented at the outset from deviating away from the guide channel S until the flight assistive operation is transferred to the auxiliary nozzle 7A. In this manner, optimum weft yarn selection and insertion can be achieved without providing jet fluid controlling auxiliary nozzles ahead of a plurality of the weft yarn inserting main nozzles as conventionally.

In addition, since the angle of tilt $\theta$ of the guide channel can be adjusted as desired, the angle $\theta$ can be set to an otpimum value depending upon the kind and number of denier of the weft yarn. Moreover, the support 8 can be slid along the guide groove 1*a* as a function of the setting of the angle $\theta$ for setting the optimum interval between the main nozzles 11, 12 and the auxiliary nozzle 7A.

Figure 4:
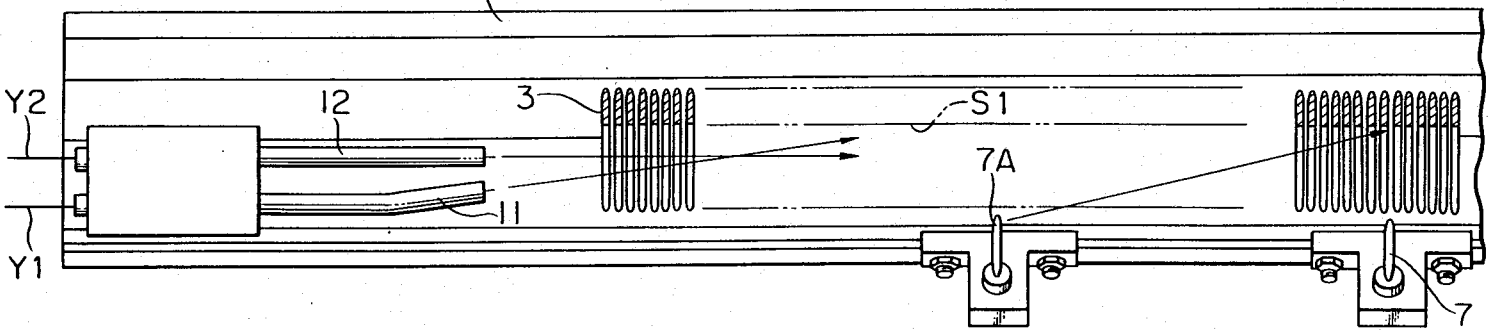
FIG. 4 is a plan view showing essential parts of a modification of the first embodiment.
Figure 5:
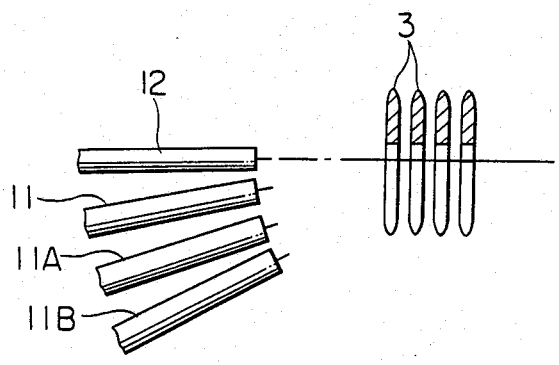
FIG. 5 is a plan view showing essential parts of a second modification of the first embodiment.
Figure 6:
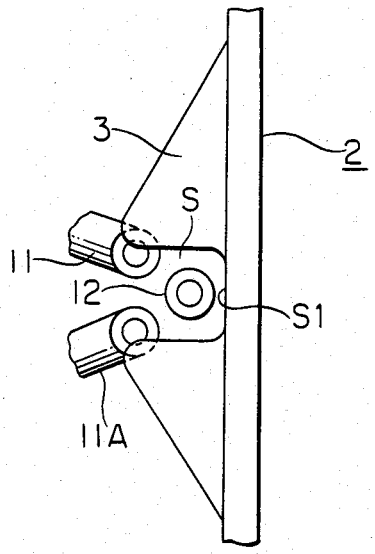
FIG. 6 is a side view showing essential parts of a third modification of the first embodiment.

According to the present invention, the plural main nozzles 11, 12 can be designed as one unit and arranged in the weft-inserting position ahead of the guide channel S (FIG. 4). Alternatively, two or more weft-inserting main nozzles (three nozzles 11, 11A and 11B in FIG. 5) can be horizontally arranged in a fan shape for directing the fluid towards the recessed wall surface S1 of the weft yarn guide channel S. Still alternatively, two nozzles 11, 11A can be placed as shown in FIG. 6 above and below the nozzle 12. The axis of projection C may also be directed to a point beyond the point of intersection between the axis A of the auxiliary nozzle 7A and the wall surface S1.

The above described first embodiment of the present invention is directed to a loom in which the weft yarn guide channel is defined by a modified reed. In the embodiment shown in FIGS. 7 to 9, the present invention is applied to the weft-inserting device in which the guide channel is defined by a row of weft yarn guide members separate from the reed.

Figure 7:
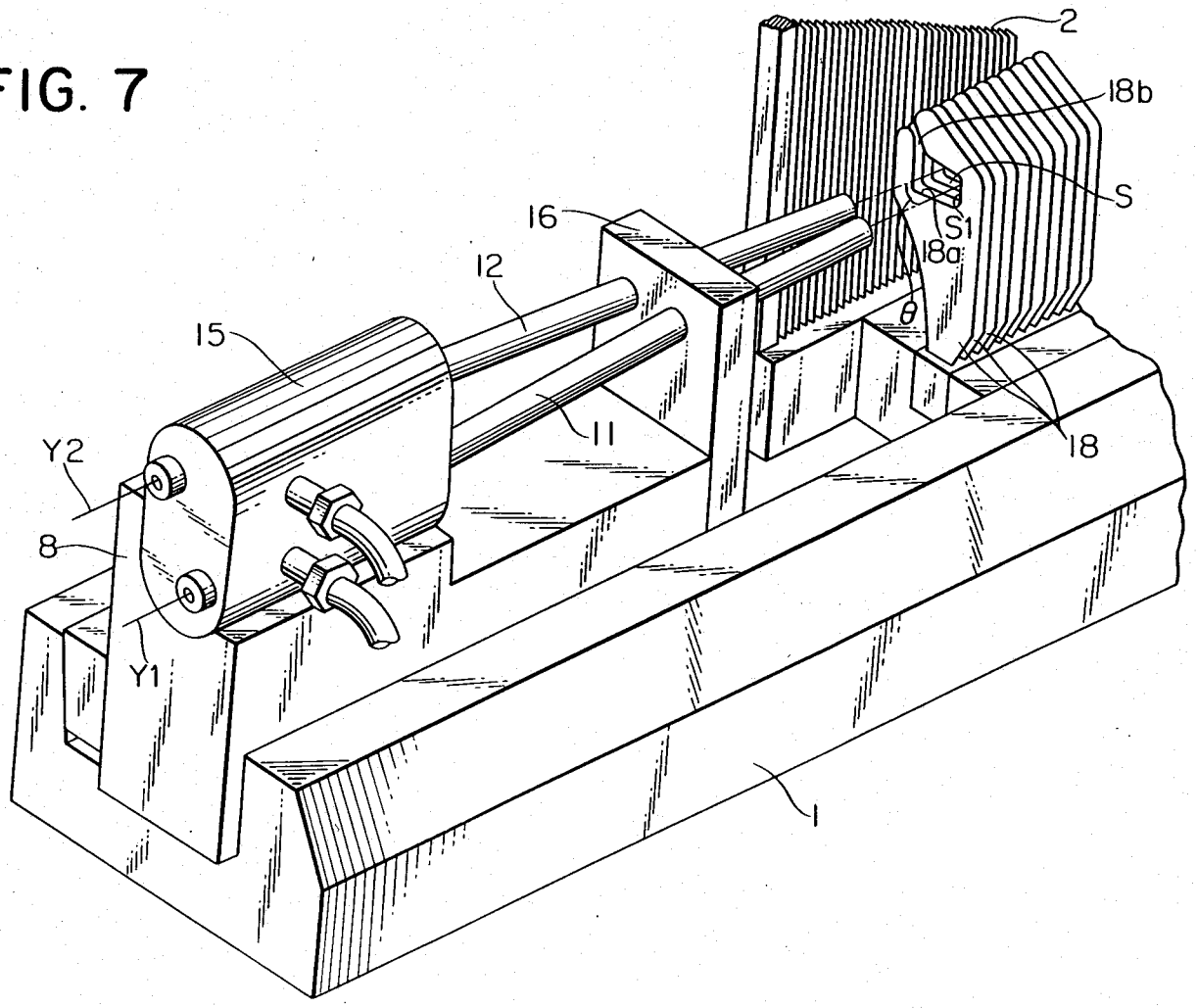
FIG. 7 is a perspective view showing a second embodiment of the weft-inserting device of the fluid jet loom of the present invention.
Figure 8:
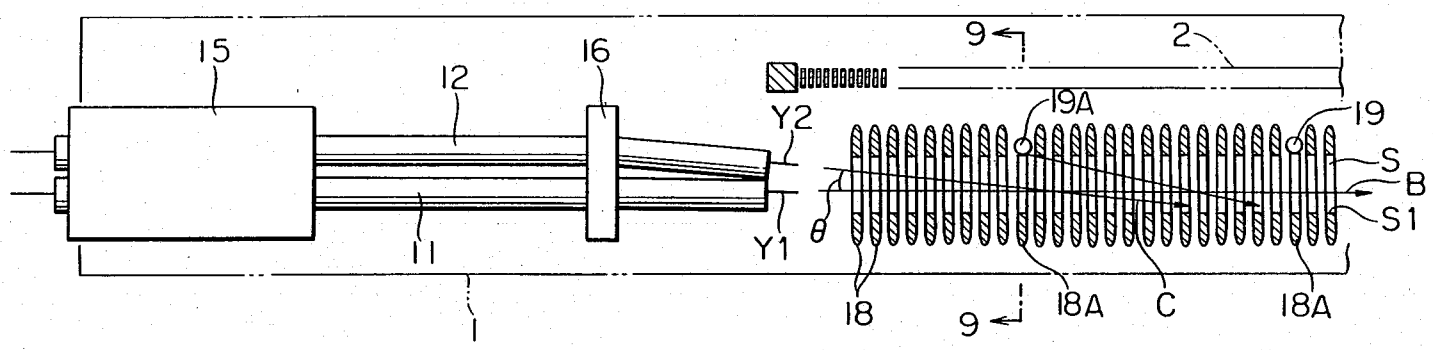
FIG. 8 is a sectional, plan view of FIG. 7.
Figure 9:
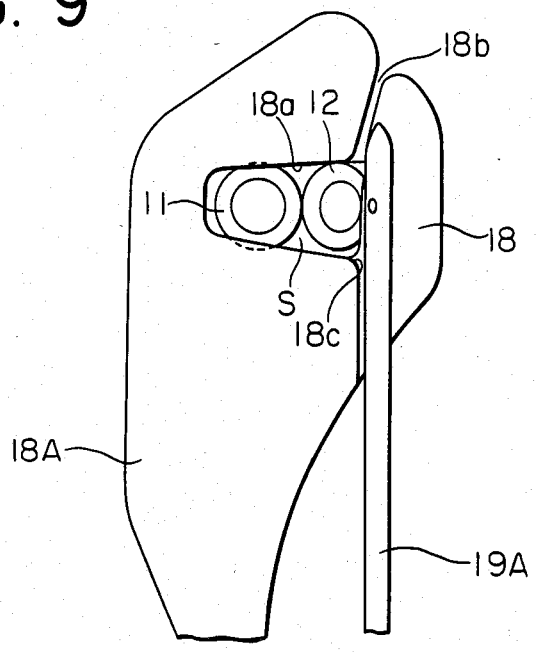
FIG. 9 is an enlarged sectional side view along line 9—9 of FIG. 8.

Referring to FIGS. 7 to 9, in the nozzle holder 15 provided on the support 8 are disposed weft-inserting main nozzles 11, 12 one above the other and with transverse positional shift with the mid portions of the nozzles being retained by a supporting member 16.

Ahead of the main nozzles 11, 12 are mounted a large number of weft yarn guide members 18, 18A side by side and in front of the reed 2. The yarn guide channel S is defined by the row of guide apertures 18*a* of the guide members 18, 18A. Slit-like exit apertures 18*b* are formed in the guide members 18 in communication with the guide apertures 18*a*. Each guide member 18A has a weft yarn exit aperture 18*c* opened wide apart towards the reed 2. A number of such guide members 18A are provided with preset intervals between the yarn guide members 18. Auxiliary nozzles 19, 19A are mounted upright between the respective yarn guide member 18A and the reed 2.

The main nozzle 11 has its forward end projecting ahead of the longitudinal axis of the guide channel S similarly to the preceding embodiment, while having its jet axis extending in the direction shown by the arrow mark B in FIG. 8. The axis B is slightly shifted away from the usual weft-inserting center of the guide channel S towards the recessed wall surface S1 of the guide channel S. Similarly to the first embodiment, the other main nozzle 12 also has its forward end extended forwardly of the supporting member 16 and with a tilt with respect to the longitudinal axis of the guide channel S. The jet axis of the main nozzle 12 is extended in the direction of the arrow mark C, as shown in FIG. 8. The angle of tilt of the jet axis C with respect to the longitudinal axis of the guide channel S is defined as the angle $\theta$ between it and the recessed wall surface S1 of the guide passage S, as shown in FIGS. 7 and 8. As can be seen from FIG. 8, the yarn Y1 is inserted at the safe side spaced apart from the exit aperture 18*b* and into the guide channel S as conventionally so as to be assisted in the course of forward travel thereof by the auxiliary nozzle 19A.

The fluid projection or operation of the main nozzles 11, 12 is controlled by a magnetic valve, not shown, in accordance with the weft yarn selection program to permit free selection of the insertion pattern, while making it possible to handle the complex insertion pattern. The switching between the weft-inserting main nozzles can be performed so as to follow the operation of the high speed loom by fast response of the magnetic valve. The forward travel of the weft yarn in the channel S and the operation of the projected fluid on the weft yarn are essentially the same as that of the first embodiment as described hereinabove.

Figure 10:
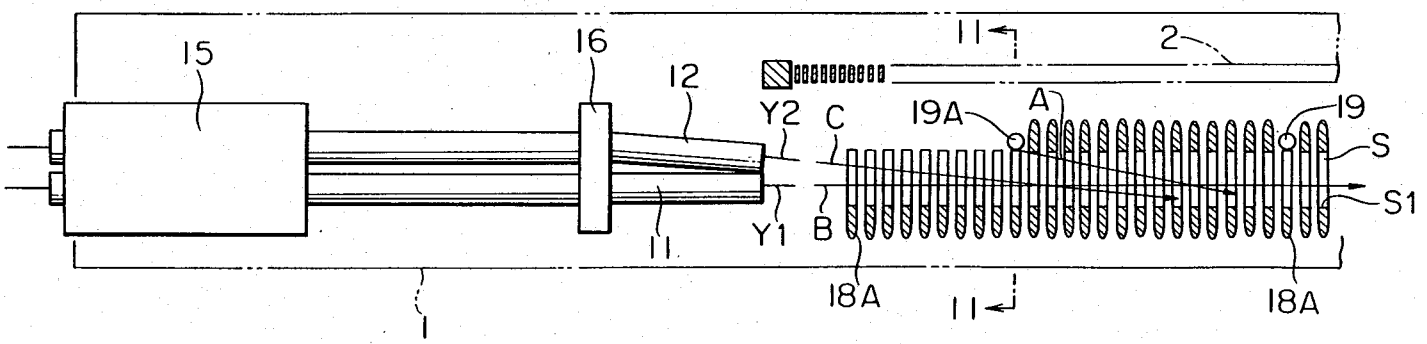
FIG. 10 is a sectional plan view showing a modification of the second embodiment of the weft inserting device of the present invention.
Figure 11:
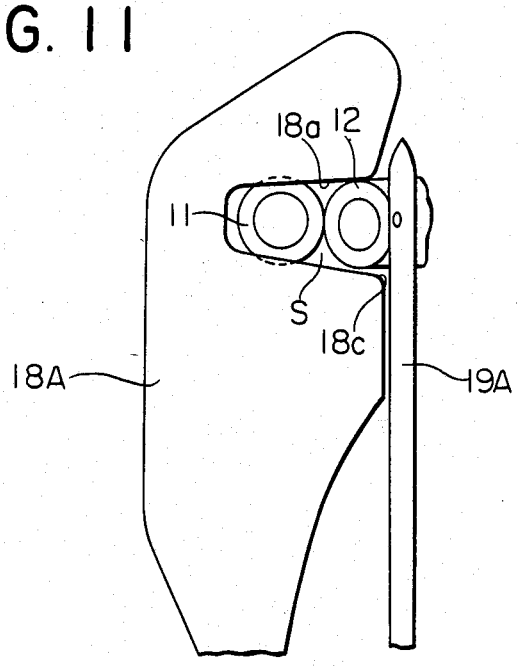
FIG. 11 is an enlarged sectional side view along line 11—11 of FIG. 10.

The second embodiment can be modified in such a manner that, as shown in FIGS. 10 and 11, the yarn guide members 18A having yarn exit apertures 18*c* widely opened towards the reed 2 are provided on the side of the main nozzles 11, 12 for defining the weft yarn guide channel S. This facilitates the insertion into the guide channel S of the weft yarn Y2 projected from the main nozzle 12 having the projection axis C inclined with respect to the longitudinal axis of the guide channel S, while enlarging the setting range of the angle $\theta$ of the jet axis C with respect to the longitudinal axis of the channel S and making it possible to use more than three main weft-inserting nozzles.

In the modification shown in FIGS. 10 and 11, the axis C is extended to intersect axis B at a position closer to the main nozzles 11, 12 than the point of intersection between the jet axis A from the auxiliary nozzle 19A and the recessed wall surface S1. Alternatively, the axis C may be extended to a position beyond such point of intersection.

Similar results may be achieved when the yarn guide channel S is defined solely by the weft yarn guide members 18 having slit-like exit apertures.

Figure 12:
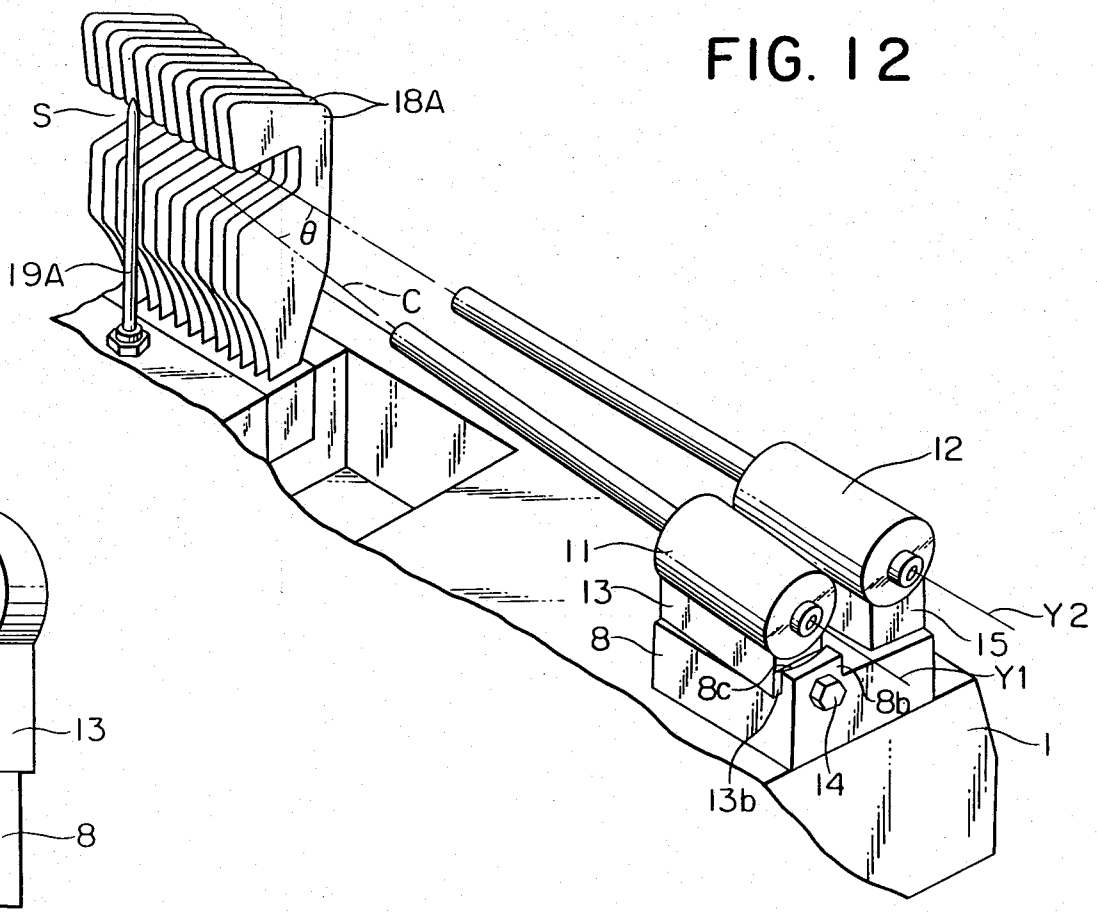
FIG. 12 is a perspective view showing a further modification of the weft-inserting device of the present invention.
Figure 13:
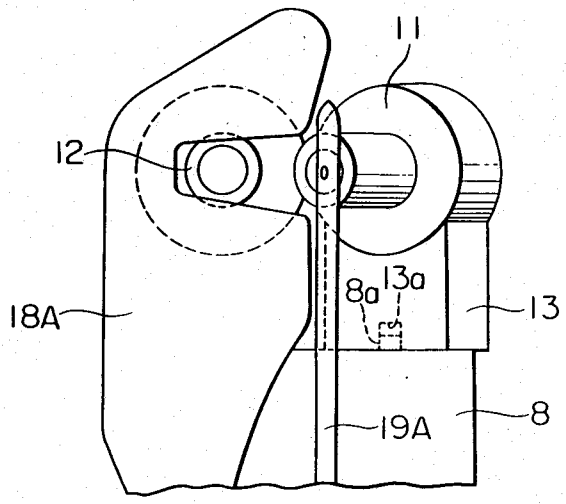
FIG. 13 is a side view showing essential parts of the weft-inserting device of FIG. 12, when seen from the side opposite to the main nozzle.

The second embodiment can be modified as shown in FIGS. 12 and 13 wherein the main nozzles 11, 12 are supported on the sley 1 similarly to the preceding first embodiment and the main nozzle 11 may be adjustably rotated about the boss 8A on the support as center. Hence, the angle of tilt $\theta$ of the jet axis C of the main nozzle 11 can be adjusted so that the optimum tilt angle can be set at all times in dependence upon the kind or the number of denier of the weft yarn.

In FIGS. 14 to 18, there is shown a third embodiment of the present invention, wherein the weft yarn guide passage S is provided by the recessed guide apertures 3*a* in the teeth 3 of the reed 2, as in the first embodiment while the auxiliary nozzles 7, 7A are provided in similar manner.

Figure 14:
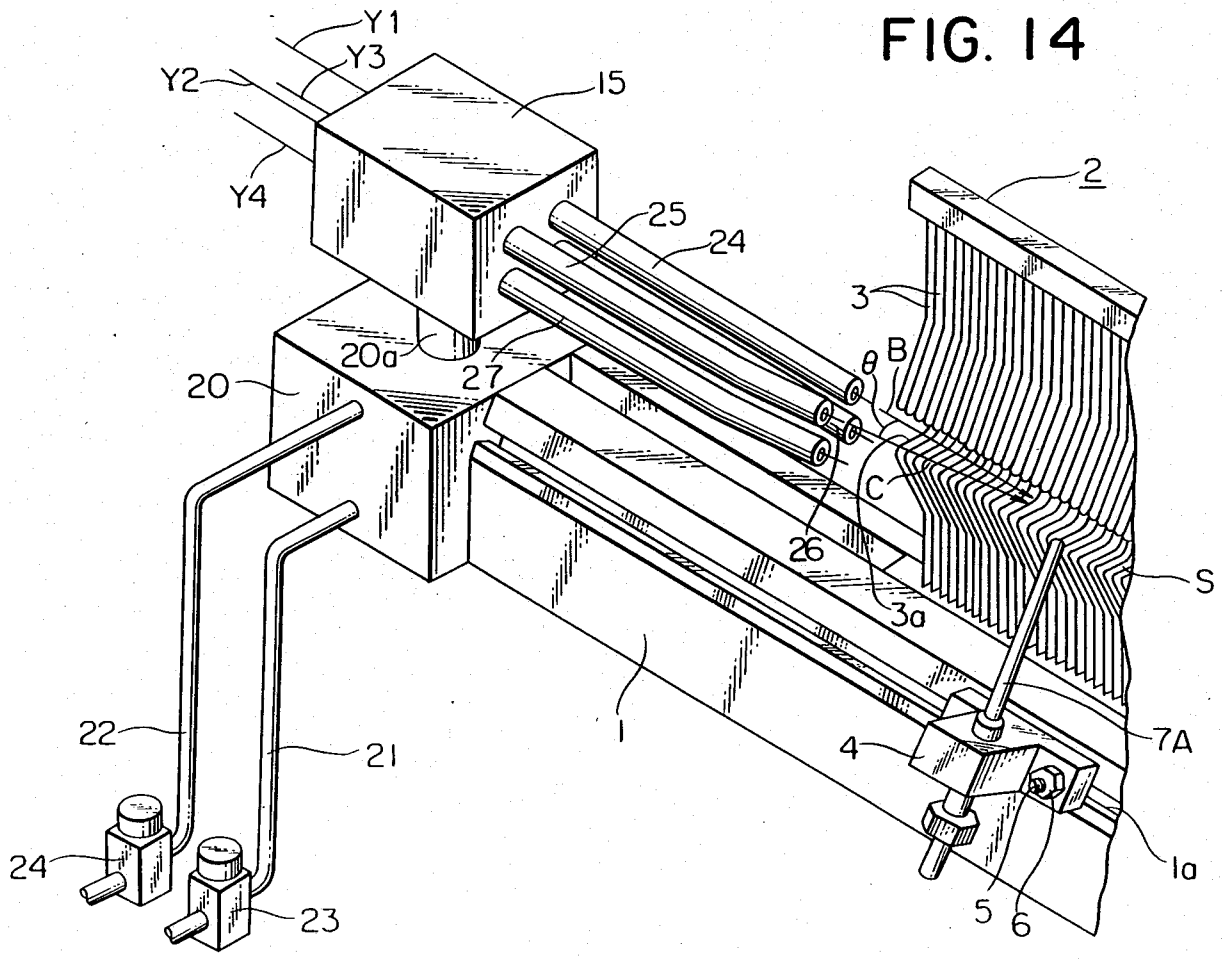
FIG. 14 is a perspective view showing a third embodiment of the weft-inserting device of the fluid jet loom of the present invention.
Figure 15:
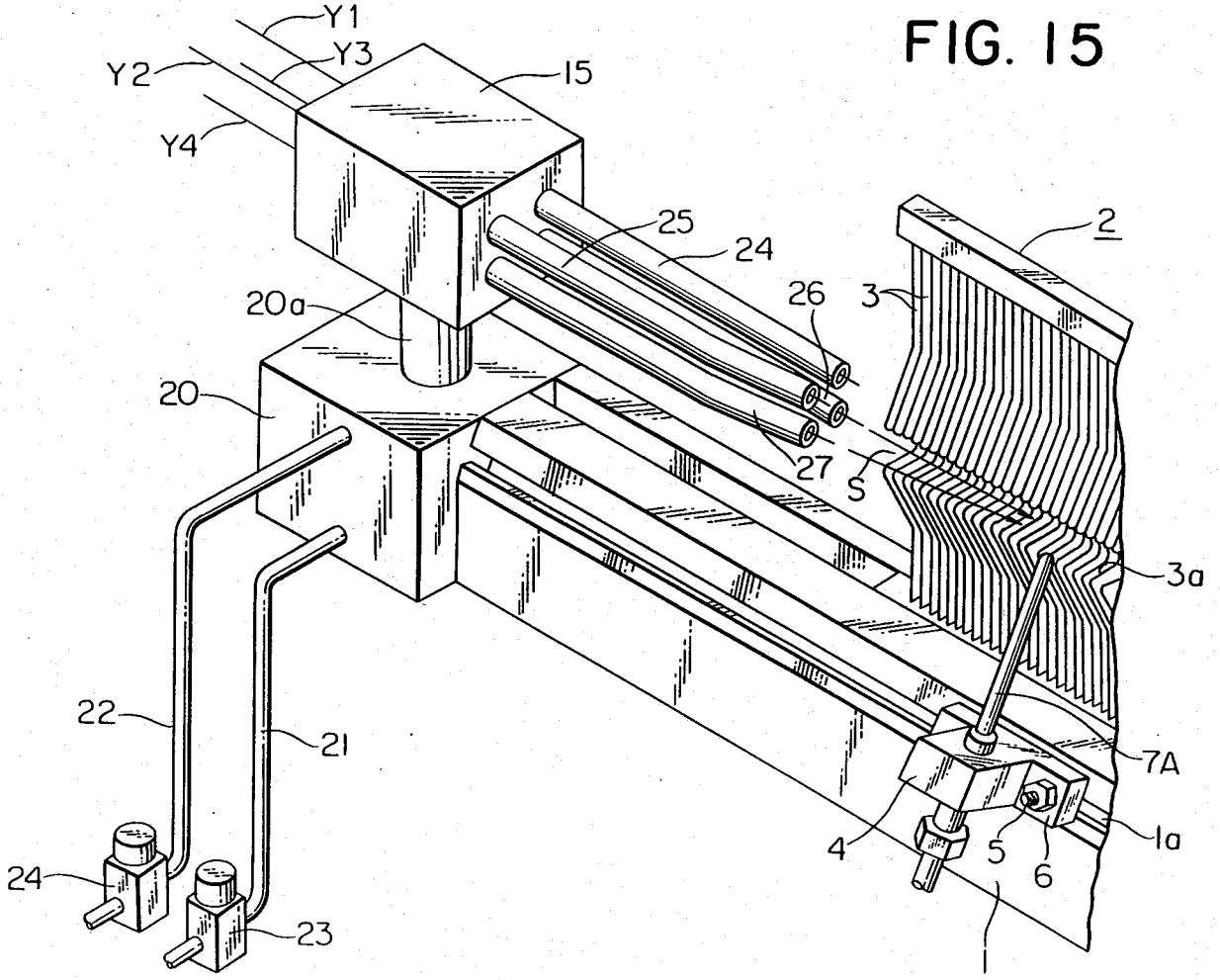
FIG. 15 is a perspective view showing the set of main nozzles shifted upward from the state shown in FIG. 1.
Figure 16:
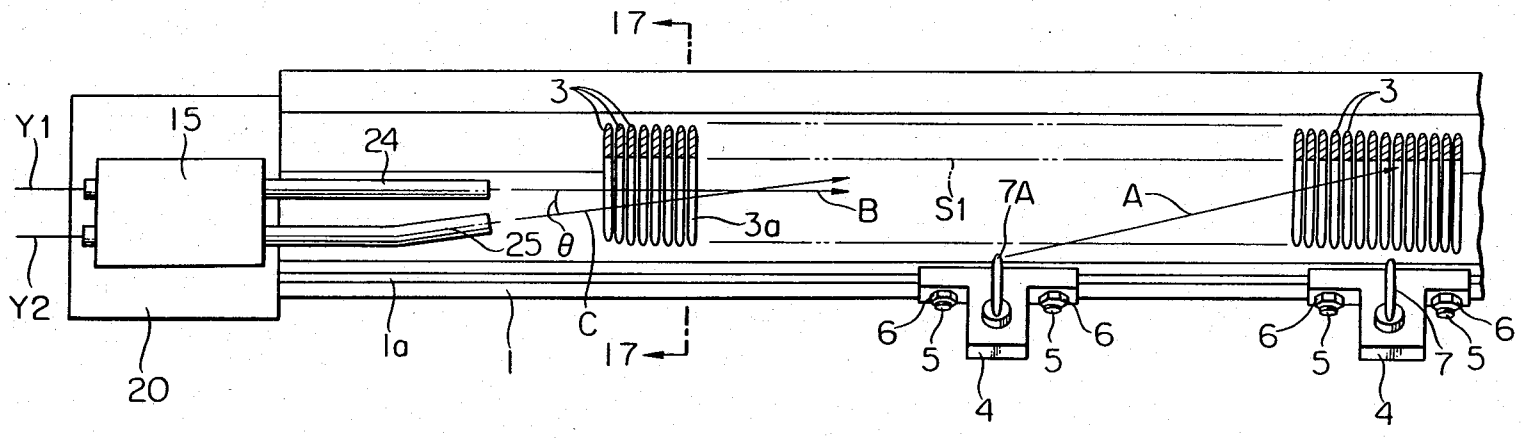
FIG. 16 is a plan view of the weft-inserting device of FIG. 14.

In the present third embodiment, an air cylinder 20 in the form of a block is affixed to one end face of the sley 1 towards the weft-inserting side and connected to a source of compressed air, not shown, through a pair of supply pipes 21, 22 and magnetic valves 23, 24. The piston rod 20*a* of the cylinder 20 can be raised or lowered by opening or closing the magnetic valves 23, 24. These valves 23, 24 are three way valves having an air discharge port and so designed that the air discharge port may be closed and opened when the valve is opened and closed, respectively. That is, with the valve 23 opened and the valve 24 closed, the piston rod 20*a* is projected upward (FIG. 15). With the valve 24 opened and the valve 23 closed, the piston rod 20*a* is receded downward (FIG. 14). The operation of the magnetic valves 23, 24 is controlled in accordance with the preset weft-inserting pattern and on the basis of the operational commands from the control system, not shown.

To the upper end of the piston rod 20*a* is attached a nozzle holder 15 in which are provided four weft-inserting main nozzles 24, 25, 26, 27 adapted for projecting into the guide passage S the weft yarns Y1, Y2, Y3 and Y4 supplied from the four weft yarn supply sources, not shown. These main nozzles 24 to 27 are connected to the source of compressed air through supply pipes and magnetic valves, not shown. The valve opening and closure is controlled in accordance with the weft-inserting patterns and on the basis of the operational commands from the control unit, not shown.

Two nozzles 24, 25 of the four main nozzles 24 to 27 are horizontally placed side by side, with the one nozzle 24 having its jet axis extending parallel to the longitudinal axis of the guide passage S as shown by the arrow mark B. The axis B is slightly shifted closer to the wall S1 of the guide channel S than the conventional weft insertion center of the guide channel S. The other main nozzle 25 has its forward end inclined with respect to the longitudinal axis of the guide passage S with the jet axis directed as shown by the arrow mark C so as to intersect the wall surface S1 of the guide passage S. The angle of tilt of the jet axis C with respect to the longitudinal axis of the guide channel S is denoted by the angle $\theta$ between the axis C and the wall surface S1. The remaining main nozzles 26, 27 are horizontally arranged side by side so as to be vertically aligned with the main nozzles 24, 25, below the weft-inserting main nozzles 24, 25. The one nozzle 26 is directed parallel to the longitudinal axis of the passage S similarly to the main nozzle 24, while the other nozzle 27 has its forward end inclined with respect to the longitudinal axis of the guide passage S with its jet axis tilted with respect to the longitudinal axis of the passage S and directed towards the wall surface S1 similarly to the weft-inserting main nozzle 25.

Figure 17:
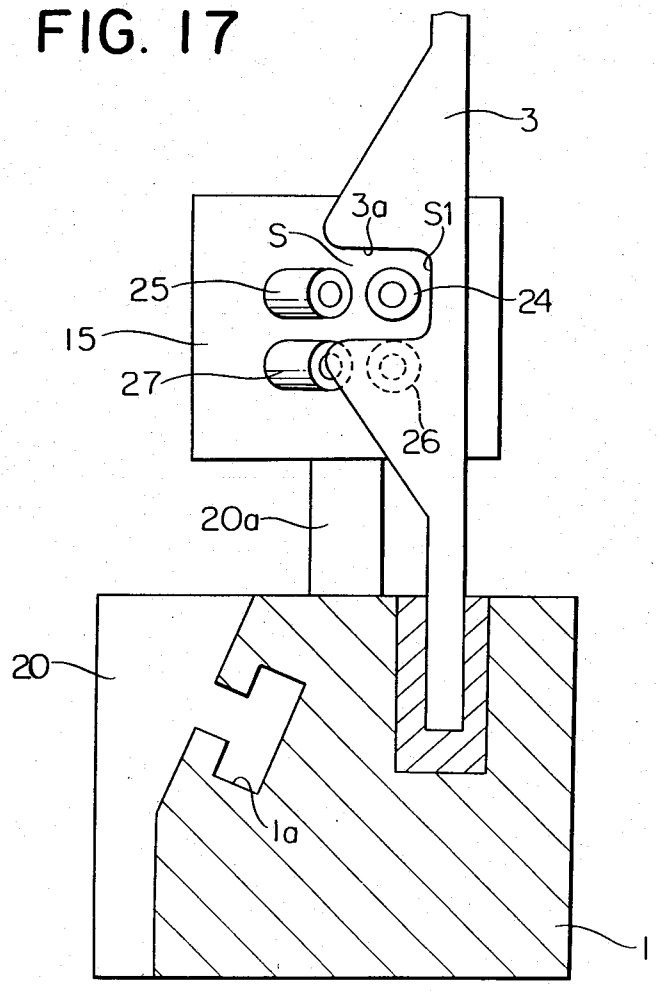
FIG. 17 is an enlarged sectional side view along line 17—17 in FIG. 16.

Referring to FIGS. 14 and 17, the valve 24 is opened and the valve 23 closed so that the piston rod 20*a* of a pneumatic cylinder or, alternatively, a magnetic solenoid, is in the receded position. The upper row of the main nozzles 24, 25 is in the weft-inserting position, that is, aligned in front of the guide channel S. One of the main nozzles 24, 25 is actuated in accordance with the weft-inserting pattern for projecting the weft yarn Y1 or Y2. The travel of the weft yarn in the guide channel S and the operation of the projected fluid on the weft yarn are essentially the same as that of the first or the second embodiment as described hereinabove.

Figure 18:
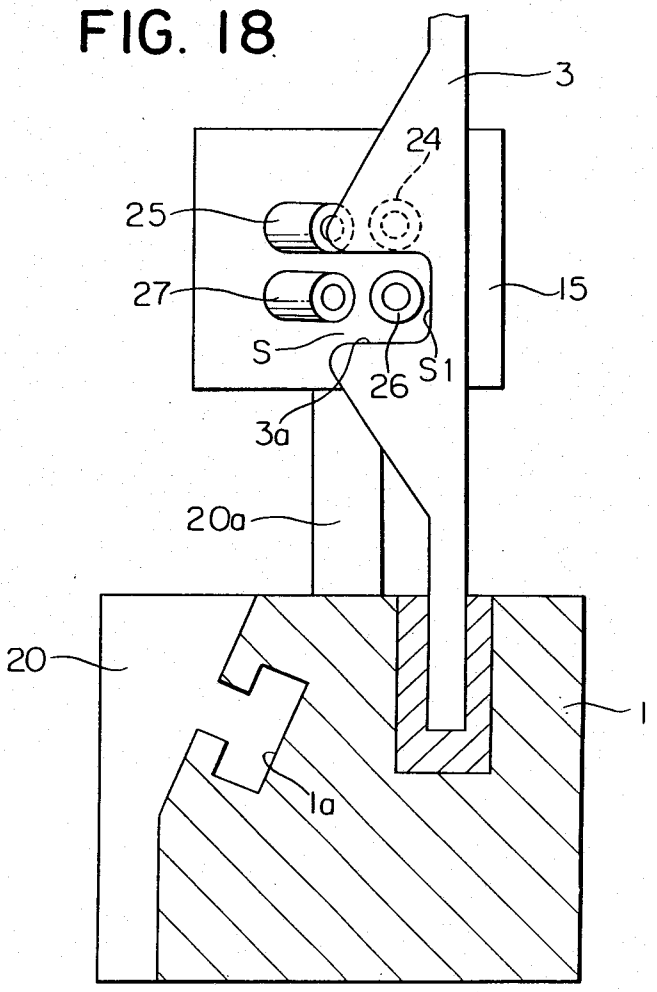
FIG. 18 is a similar view of the set of main nozzles, but shifted upward from the state shown in FIG. 16.

When one of the weft yarns Y3 and Y4 is to be inserted by the main nozzles 26, 27 of the lower row in accordance with the weft-inserting pattern, the valve 23 is opened and the valve 24 closed. The piston rod 20*a* is projected and, as shown in FIGS. 15 and 18, the main nozzles 26, 27 of the lower row are switched to the weft-inserting position. The switching may be effected by electrically controlling the opening and closure of the magnetic valves 23, 24 in accordance with the previously set weft insertion pattern. Thus the operational sequence of the magnetic valves 23, 24 can be changed as desired for bringing a desired one or ones of the main nozzles 24 to 27 to the weft-inserting position, in such a manner that the sequence of the insertion of the weft yarns Y1 to Y4 (weft insertion pattern) can be freely selected in connection with the opening and closure of the magnetic valves designed to control the operation of the main nozzles. For shifting the main nozzles 24, 25 and 26, 27 to the weft-inserting position, shifting the piston rod 20*a* vertically a short distance suffices. Because of high speed response of the magnetic valves 23, 24, the operation is achieved which will sufficiently follow up with the moving operation of the high speed loom, such as a jet loom.

The insertion of the weft yarns Y3, Y3 projected from the main nozzles 26, 27 is similar to that of the weft yarns Y1, Y2 projected from the main nozzles 24, 25.

Figure 19:
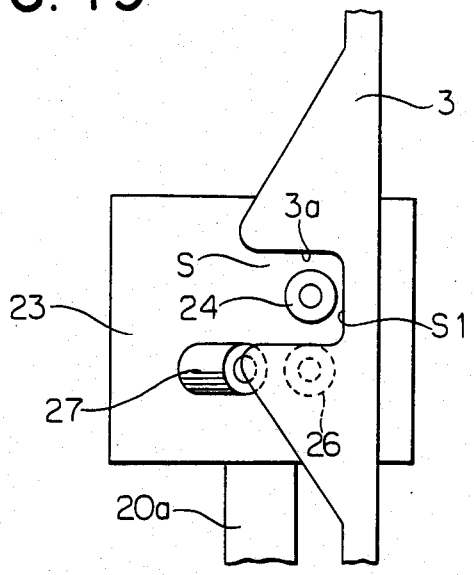
FIG. 19 is a side view showing essential parts of a modification of the third embodiment.

The above described third embodiment of the present invention can be modified as shown in FIGS. 19 to 23. In the modification of FIG. 19, the main nozzle 25 of the upper row is removed to permit insertion of three kinds of the weft yarns.

Figure 20:
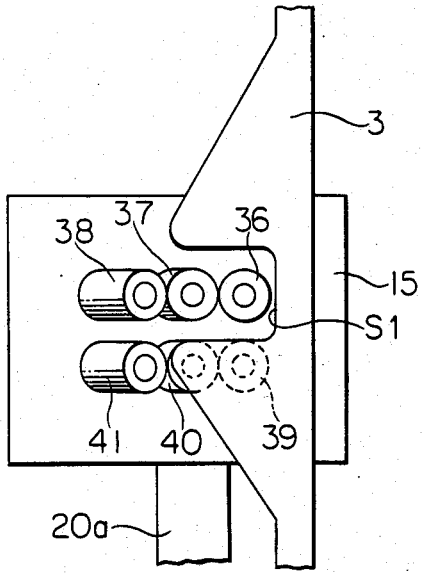
FIG. 20 is a side view showing essential parts of a further modification of the third embodiment.

In the modification shown in FIG. 20, two sets of three main nozzles 36, 37, 38; 39, 40, 41 are horizontally arranged in an upper row and a lower row respectively. The jet axes of the main nozzles 36, 39 of the two sets disposed towards the reed 2 are directed parallel to the longitudinal axis of the yarn guide channel S with the jet axes of the main nozzles 37, 38, 40, 41 being at an angle with respect to the longitudinal axis of the guide channel S and directed towards the recessed wall surface S1.

Figure 21:
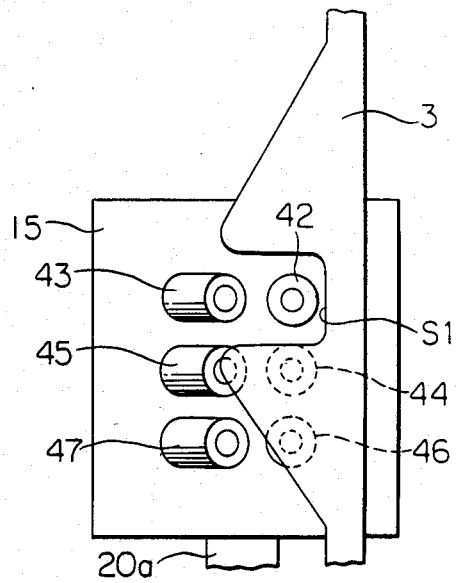
FIG. 21 is a side view showing essential parts of a further modification of the third embodiment.

In the modification of FIG. 21, three sets of two main nozzles 42, 43; 44, 45; 46, 47 are horizontally arranged in three positions, that is, an upper position, a mid position and a lower position. Only the projection axes of the main nozzles 42, 44, 46 of the three sets disposed towards the reed 2 are directed parallel to the longitudinal axis of the guide channel S, with the jet axes of the remaining main nozzles 43, 45, 47 being tilted with respect to the longitudinal axis of the guide channel S and pointing to the recessed wall surface S2. In the present modification, the degree of extension of the piston rod 20*a* of the pneumatic cylinder must be controlled in two stages. Thus, when switching the intermediate main nozzles 44, 45 to the weft-inserting position, the magnetic valves 23, 24 need to be opened or closed with the piston rod 20*a* extending to the mid position and when switching the lowermost nozzles 46, 47 to the weft-inserting position, the valve 23, 24 must be opened or closed to extend the piston 20*a* further, to align nozzles 23, 24 with channel S.

Figure 22:
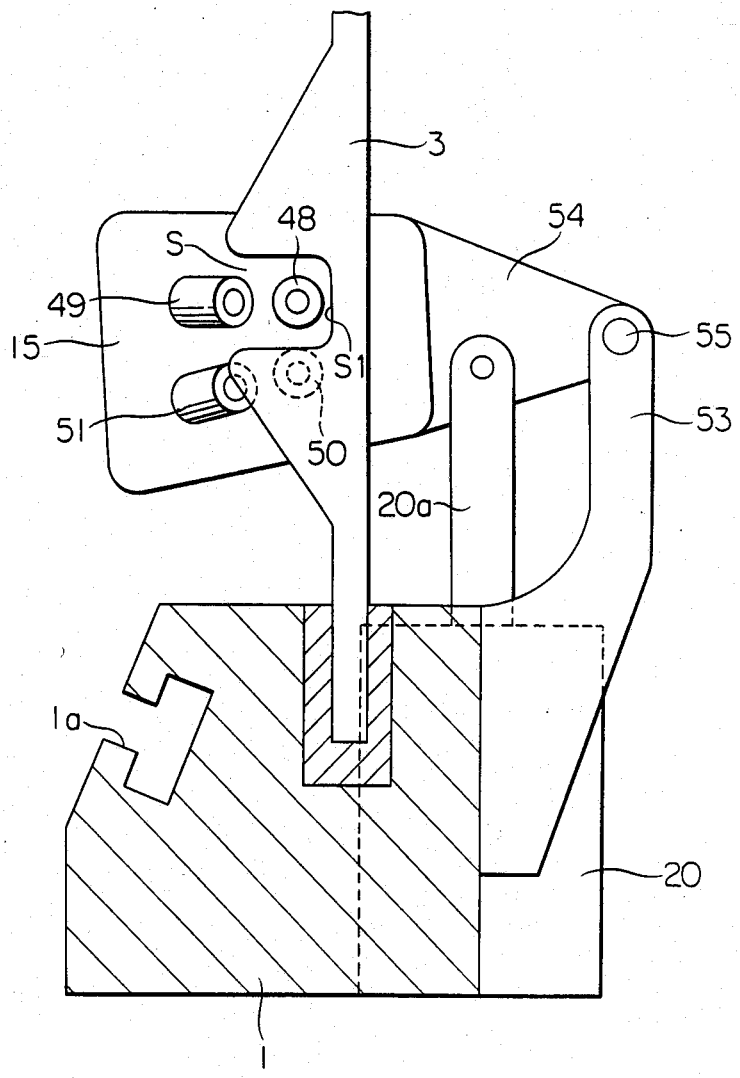
FIG. 22 is a side view showing essential parts of a further modification of the third embodiment.

In the modification of FIG. 22, two sets of two main nozzles 48, 49; 50, 51 are arranged in an upper position and a lower position in a nozzle holder 15 which is mounted for rotation about a shaft 55 through a mounting arm 54 which is pivotally connected to a supporting bracket 53 which is in turn secured to the sley 1. The piston rod 20*a* of the pneumatic cylinder 20 attached to the extreme end of the sley 1 is connected to the mounting arm 54. The jet axes of the main nozzles 48, 50 disposed towards the reed 2 extend parallel to the longitudinal axis of the weft yarn guide channel S, while those of the remaining main nozzles 49, 51 are inclined with respect to the longitudinal axis of the guide passage S and point to the wall surface S1. The upper and lower sets of the main nozzles are radially arranged about the shaft 55. Thus, with the vertical movement of the piston rod 20*a*, the upper and lower sets of the main nozzles are swung about shaft 55 so as to be alternately shifted to the weft-inserting position.

Figure 23:
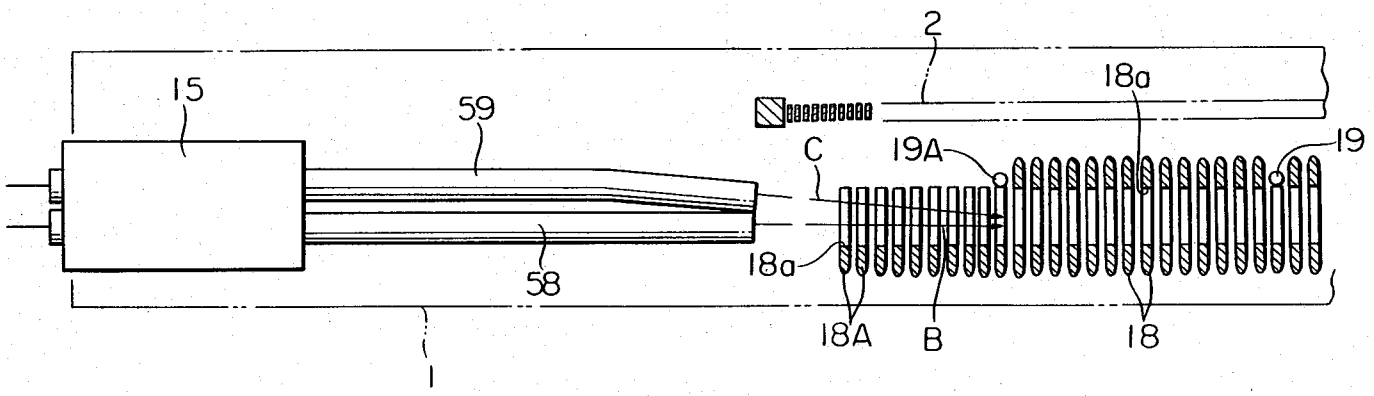
FIG. 23 is a sectional plan view showing essential parts of another modification of the third embodiment.

In the modification shown in FIG. 23, the guide channel S of the jet loom is defined by a row of guide apertures 18*a* of a large number of weft yarn guide members 18, 18A placed side by side along the inserting direction and in opposition to the reed 2. Four main nozzles (only two of the upper row being shown) are vertically movably supported by a pneumatic cylinder, not shown. The jet axis C of the main nozzle 59 disposed towards the reed 2 is inclined with respect to the passage S to point to the wall surface S1, whereas the projection axis B of the main nozzle 58 disposed towards the guide members 18 extends parallel to the longitudinal axis of the channel S. The guide member 18A disposed towards the main nozzles is provided with weft yarn exit apertures widely opened apart at the reed side, whereas the remaining yarn guide members 18 are provided with slit-like weft exit apertures towards the reed 2.

It will be understood that the above description of the present invention is susceptible to various modifications, changes and adaptations, and the same is intended to be comprehended within the meaning and range of equivalents of the appended claims.

What we claim is:

1. A weft-inserting device for inserting weft threads into a warp shed in a fluid jet loom having a sley, and an aligned plurality of weft guides on and extending across said sley, each said weft guide having means defining a weft guide aperture for passage of said weft threads therethrough, each said aperture having an open side and a recessed wall portion opposite its said open side, all of said weft apertures being aligned and oriented to form a weft guide channel having an open side and substantially a recessed wall surface opposite to said open side formed by said recessed wall portions of said guides, said device comprising at least two weft-inserting main nozzles mounted on one end of said sley, each said main nozzle having a fluid jet opening directed substantially into said weft guide channel for inserting a weft thread therein, means for selectively emitting a jet of fluid from each of said nozzle openings for carrying respective weft threads therefrom along respective fluid jet axes into said weft guide channel, and at least one auxiliary nozzle mounted on said sley spaced away from said main nozzle openings and having a fluid jet opening positioned for emitting a jet of fluid into said weft guide channel in a direction away from said main nozzle openings and inclined towards said recessed wall surface for assisting movement of said weft threads through said channel, one of said main nozzles having its said fluid jet axis directed parallel to said recessed wall surface, and another of said main nozzles having its said fluid jet axis inclined towards said recessed wall surface, whereby said fluid jet from said auxiliary nozzle maintains said weft threads within said weft guide channel.

2. The device according to claim 1, wherein said sley has a reed mounted thereon, and said weft guides defining the weft guide channel are reed teeth.

3. The device according to claim 1, wherein said sley has a reed mounted thereon, and said weft guides defining the weft guide channel are a number of yarn guide members juxtaposed parallel to the reed.

4. The device according to claim 1, which further includes means mounting said inclined main nozzle on said sley for rotationally changing the angle between its said jet axis and said jet axis of the first said main nozzle.

5. The device according to claim 4, wherein said mounting means is slidable longitudinally with respect to said weft guide channel.

6. The device according to claim 4, wherein said inclined main nozzle mounting means is rotatable within a horizontal plane which includes the longitudinal axis of said yarn guide channel.

7. The device according to claim 1, wherein said inclined main nozzle has its jet axis directed to a location which is closer to said main nozzle openings than the point of intersection between said jet axis of said auxiliary nozzle and said recessed wall surface of said weft guide channel.

8. The device according to claim 1 which comprises a plurality of said inclined main nozzles having respective inclined jet axes arranged in a sector shape within a horizontal plane.

9. The device according to claim 1 which comprises a plurality of said inclined main nozzles having respective inclined jet axes arranged in a sector shape within a vertical plane.

10. A selective weft insertion device for a jet loom having a sley, a reed mounted on an extending across said sley, and an aligned plurality of weft-guide members mounted on and extending across said sley in parallel, laterally spaced relation to said reed, each said weft-guide member having means defining a weft guide aperture therethrough, all of said weft-guide apertures being aligned with each other to form a weft-guide channel extending across said sley, said device comprising a plurality of weft-inserting main nozzles disposed at one end of said sley and having respective fluid jet openings facing toward the adjacent end of said weft-guide channel, means for selectively emitting a jet of fluid from each of said nozzle openings for carrying respective weft threads therefrom along respective fluid jet axes into said weft-guide channel, and a plurality of auxiliary nozzles mounted on said sley in spaced-apart relation thereacross and between respective ones of said weft-guide members on one side of said weft-guide channel, each of said auxiliary nozzles having a fluid-jet opening for emitting a jet of fluid into said weft-guide channel in direction away from said one end of said sley and towards the opposite side of said channel for assisting movement of said weft threads through said channel, at least one of said main nozzles having its said fluid jet axis extending parallel to and within said chnnel, the remaining of said plurality of weft-inserting main nozzles being disposed adjacent thereto and at the side thereof corresponding to said one side of said weft-guide channel with their said respective jet axes each directed in said direction away from said end of said sley within, and inclined with respect to said weft-guide channel.

11. The device according to claim 10, wherein a sequential plurality of said weft yarn guide members disposed on said end of said weft guide channel adjacent to said main nozzles each have means defining a large weft exit opening extending to its said weft aperture on said one side of said channel to facilitate weft insertion from said main nozzles having inclined jet axes, the remaining weft guide members each having means defining small slit-like weft exit openings extending to its said weft aperture on said one side of said channel.

12. The device according to claim 10, wherein said main nozzles having jet axes inclined with respect to said weft guide channel are each supported by means for rotationally changing the angle between its said jet axis and said jet axis of said at least one main nozzle.

13. A selective weft insertion device according to claim 10, comprising at least three weft-inserting main nozzles at least two of which are directed parallel to said weft yarn guide channel and vertically aligned with one another, said weft-inserting main nozzles being mounted on means for reciprocating the main nozzles vertically as one unit for alternately positioning said fluid jet openings of said vertically aligned main nozzles in alignment with said adjacent end of said weft guide channel.

14. The device according to claim 13, wherein said means for reciprocating the main nozzles comprises a fluid cylinder and a piston rod vertically actuated by said cylinder and connected to said weft-inserting main nozzles.

15. The device according to claim 13, wherein said means for reciprocating the main nozzles comprises magnetic solenoid means connected to said weft-inserting main nozzles.

16. The device according to claim 13, wherein a sequential plurality of said weft guide members disposed on said end of said weft guide channel adjacent to said main nozzles each have means defining a large weft exit opening extending to its said weft aperture on said one side of said channel to facilitate weft insertion from said main nozzles having inclined jet axes, the remaining weft guide members each having means defining small slit-like weft exit openings extending to its said weft aperture on said one side of said channel.

* * * * *